US008146579B2

(12) United States Patent
Jablonski et al.

(10) Patent No.: US 8,146,579 B2
(45) Date of Patent: Apr. 3, 2012

(54) TOY EMPLOYING CENTRAL SHAFT COCKING MECHANISM FOR RAPID FIRE PROJECTILE LAUNCHING AND METHOD THEREOF

(75) Inventors: Brian Jablonski, Providence, RI (US); Raymond Aaron Mead, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 358 days.

(21) Appl. No.: 12/545,277

(22) Filed: Aug. 21, 2009

(65) Prior Publication Data

US 2011/0041824 A1 Feb. 24, 2011

(51) Int. Cl.
*F41B 11/00* (2006.01)

(52) U.S. Cl. ..... 124/65

(58) Field of Classification Search ..... 124/63–69
See application file for complete search history.

(56) References Cited

U.S. PATENT DOCUMENTS

| | | | | |
|---|---|---|---|---|
| 1,237,928 | A | 8/1917 | MacLean | |
| 4,289,109 | A | 9/1981 | D'Andrade | |
| 4,834,059 | A | 5/1989 | Moorhouse et al. | |
| 4,848,307 | A * | 7/1989 | Tsao | 124/59 |
| 5,186,156 | A * | 2/1993 | Clayton | 124/59 |
| 5,529,050 | A | 6/1996 | D'Andrade | |
| 5,553,598 | A | 9/1996 | Johnson et al. | |
| 5,660,159 | A * | 8/1997 | Clayton | 124/66 |
| 5,787,869 | A | 8/1998 | Johnson et al. | |
| 5,791,326 | A | 8/1998 | Brown et al. | |
| 6,439,216 | B1 | 8/2002 | Johnson et al. | |
| 7,267,118 | B2 | 9/2007 | Eddins et al. | |
| 7,287,526 | B1 | 10/2007 | Bligh et al. | |
| 2007/0006862 | A1 * | 1/2007 | Zimmerman | 124/66 |
| 2007/0101982 | A1 * | 5/2007 | Ong et al. | 124/65 |
| 2011/0017186 | A1 * | 1/2011 | Gore | 124/66 |

* cited by examiner

*Primary Examiner* — Troy Chambers
(74) *Attorney, Agent, or Firm* — Perry Hoffman

(57) ABSTRACT

A toy for launching two or more projectiles employing a central shaft cocking mechanism for rapid fire projectile launching through quick, simple and fun cocking and triggering mechanisms. The toy includes a housing assembly, a projectile device disposed about the housing with two or more projectiles, a piston and cylinder assembly. The piston is secured to the housing in a fixed position and the cylinder is slidably mounted on the piston, a cocking mechanism in mechanical communication with the piston and cylinder assembly including a shaft extending through the projectile device for engagement with the cylinder capable of moving the cylinder to a cocked position. A trigger mechanism is secured to the housing capable of advancing the projectile device to a firing position and capable of releasing the cylinder from a cocked position to advance the cylinder on the fixed piston and discharge a burst of compressed air launching a projectile.

20 Claims, 8 Drawing Sheets

TOY EMPLOYING CENTRAL SHAFT COCKING MECHANISM FOR RAPID FIRE PROJECTILE LAUNCHING AND METHOD THEREOF

BACKGROUND OF THE INVENTION

1. Field of the Invention

The present invention relates to toy projectile launchers and more particularly to a pump style toy projectile launcher employing a central shaft cocking mechanism extending through a projectile device for rapid fire projectile launching through quick, simple and fun cocking and triggering mechanisms which are easy to actuate.

2. Background of the Invention

Toy projectile launchers which shoot or launch projectiles have been popular for many years. These launchers have been designed over the years to launch projectiles one at a time in a reload mode, or rapid fire mode through various methods including magazines, indexing wheels, and drop down chambers which continuously feed projectiles into a gun barrel. Additionally, many of the launchers utilize bursts or streams of pressurized or compressed fluid as a convenient and reliable force in which to eject the toy projectiles.

Various mechanisms for storing and delivering a burst or stream of compressed air are known to include manual and automated air pumps, motor driven air pumps, compressed gas lines, or canisters of compressed gas, etc., employed in toy launchers. These include, e.g., U.S. Pat. No. 7,287,526 to Bligh et al. for "Toy projectile launcher with slidable outer cylinder and stationary inner compression member" issued Oct. 30, 2007, U.S. Pat. No. 7,267,118 to Eddins et al. for "Toy system with detachable weapons" issued Sep. 11, 2007, U.S. Pat. No. 6,439,216 to Johnson et al. for "Automatic pressurized fluid gun" issued Aug. 27, 2002, U.S. Pat. No. 5,787,869 to Johnson et al. for "Compressed air toy gun" issued Aug. 4, 1998.

Further means for generating and storing the mechanical energy needed to launch the projectiles may be in the form of a cocked spring mechanism, with a piston or plunger for compressing a column of air, a chamber or fluid reservoir holding air in a compressed state, and a piston and cylinder assembly with a movable cylinder generating a burst of compressed air when released to slide over the stationary piston, all known to propel the projectile upon release of the stored mechanical energy. Manual air pumps are mechanically differently from motor driven or continuous air lines or canisters because manual air pumps must also include mechanisms for manually charging or cocking the toy launcher before it can be fired.

Toy launchers employing manual air pumps are very well known in the art and reliably deliver a burst of compressed air to launch toy projectiles. Known manual air pumps are seen to employ the cocked spring mechanism, fluid reservoir, and piston and cylinder assemblies as described above. Cocking the compression spring, piston, plunger, or cylinder of the known manual air pumps includes various mechanisms manually actuated by a user.

For example, it is known to employ a breech slide mounted to an outside surface of a gun frame to retract a spring loaded piston and piston rod within a cylinder to a cocked position. The breach slide is secured to the piston rod and slides longitudinally upon the upper rearward part of the frame portion of the toy gun above the handle. The breach slide is pulled by a user away from the muzzle of the toy gun, pulling the piston rod and piston to a cocked position. The breach slide is known only to reside on the outside surface of the gun housing for manual access by a user and cannot extend through the projectile chamber.

Another known cocking mechanism includes a grip mounted to slide on the outside surface of a barrel of a toy gun. The grip is connected to a ring encircling a casing contained within the barrel and including a compression spring. The grip is pulled toward the muzzle of the barrel by a user moving the casing toward the muzzle compressing and cocking the spring. An additionally known cocking mechanism includes a slide member mounted to an outside surface of a toy gun and operable to slide along the housing to cock the spring loaded cylinder. The slide member includes a rod which contacts a shoulder of the cylinder when the slide is drawn away from the muzzle of the gun by a user to cock the slidable cylinder on the fixed piston.

Significantly, known toy launchers do not include a cocking mechanism capable of extending through a projectile device. It would be desirable to provide a central shaft cocking mechanism extending through a projectile device for manually cocking a spring loaded cylinder on a fixed piston enabling the toy launcher to rapid fire two or more loaded projectiles. The cocking mechanism extending through the projectile device facilitates a mechanical communication between a trigger mechanism and the projectile device capable of advancing the device to a firing position with the same trigger pull used to release the cocked cylinder and launch the projectile.

SUMMARY OF THE INVENTION

The present invention addresses the shortcomings of the prior art to provide a toy projectile launcher which extends a central cocking mechanism through a projectile device to simply yet uniquely cocks the piston and cylinder assembly and position the trigger mechanism for the rapid fire of two or more projectiles. A shaft extending through the projectile device for engagement with the cylinder is capable of moving the cylinder to a cocked position and facilitates quick, simple and fun cocking and triggering mechanisms for rapid fire projectile launching.

In one embodiment of the invention, the toy for launching two or more projectiles includes a housing assembly, a projectile device disposed about the housing and including two or more projectiles, a piston and cylinder assembly, wherein the piston is secured to the housing in a fixed position and the cylinder is slidably mounted on the piston, a cocking mechanism in mechanical communication with the piston and cylinder assembly including a shaft extending through the projectile device for engagement with the cylinder capable of moving the cylinder to a cocked position, and a trigger mechanism secured to the housing. The trigger mechanism is capable of advancing the projectile device to a firing position and capable of releasing the cylinder from a cocked position to advance the cylinder on the fixed piston and discharge a burst of compressed air launching a projectile.

In another embodiment of the invention, the cylinder further includes a cocking shoulder and the shaft further includes a charging contact element disposed at an end opposite the projectile device for engagement with the cocking shoulder. In another embodiment, the cocking mechanism further includes a cocking handle disposed on the shaft at an end opposite the charging contact element and the shaft is biased away from contact with the cylinder toward an uncocked position.

In another embodiment of the invention, the projectile device includes a barrel rotatably disposed on the shaft having multiple projectile compartments and the barrel further facilitates the delivery of discharged compressed air from the piston and cylinder assembly to each projectile compartment. In yet another embodiment, the rotatable barrel further includes first and second coaxial barrels disposed adjacent each other about the shaft for facilitating the advancement of the barrel and alignment of a projectile compartment to a firing position when the trigger mechanism is actuated.

In still another embodiment of the invention, the first barrel includes notches with an angled end disposed around the outer periphery defining a first set of slots with an angled end and wherein the second barrel includes notches with an end angled in a reverse direction of the first notches disposed around the outer periphery and offset from the first notches to define a second set of slots with an end angled in a reverse direction positioned offset from the first set of slots. In yet another embodiment, the trigger mechanism includes a trigger element and an advance lever capable of mechanically communicating with the first and second sets of slots to align the projectile compartments to a firing position when the trigger element is actuated capable of launching projectiles in a rapid fire mode.

In yet another embodiment of the invention, the advance lever includes an elongated protrusion at an end opposite the trigger element capable of traveling from a second slot to an offset first slot rotating a projectile compartment to a firing position with a half click trigger pull, launching the projectile with a further full click trigger pull, and traveling to a next sequential second slot rotating a next sequential projectile compartment out of firing position with a trigger release. In yet another embodiment, an elongated barrel is included and extends from the housing aligned generally parallel to the shaft and aligned with each projectile compartment when in the firing position, such that each projectile passes through the barrel when launched.

In another embodiment of the invention, a method for launching a projectile from a toy includes the steps of providing a housing assembly, disposing a projectile device with two or more projectiles about the housing assembly, providing a piston and cylinder assembly, securing the piston in a fixed position to the housing and mounting the cylinder to slide back and forth over the piston, and providing a cocking mechanism in mechanical communication with the piston and cylinder assembly by passing a shaft through the projectile device for engagement with the cylinder facilitating the launch of two or more projectiles. Further, manually pushing the shaft into the housing assembly and into contact with the cylinder assembly forcing the cylinder to a cocked position, and activating a trigger mechanism capable of advancing the projectile device to a firing position and releasing the cylinder from a cocked position, advancing the cylinder over the fixed piston discharging a burst of compressed air launches the projectiles from the projectile device.

In still yet another embodiment of the invention, the cylinder further provides a cocking shoulder extending therefrom and the cocking mechanism further provides a charging contact element disposed on the shaft for engagement with the shoulder for moving the cylinder into a cocked position. In another embodiment, the cocking mechanism further provides a cocking handle disposed on the shaft at an end opposite the charging contact element, and in another embodiment, the step of biasing the shaft toward an uncocked position by biasing the contact element away from the cylinder is included.

In another embodiment of the invention, the projectile device further provides a rotatable barrel having multiple projectile compartments each capable of rotatably aligning with the piston and cylinder assembly in a firing position, and facilitating the delivery of compressed air discharged from the assembly to each projectile in each projectile compartment. In another embodiment, the step of advancing the rotatable barrel to rotatably align each projectile compartment to the firing position when the trigger mechanism is actuated is included.

In still yet another embodiment of the invention, a toy for launching two or more projectiles includes a housing assembly; a rotatable projectile device disposed about the housing and including two or more projectile chambers each including at least one projectile, a piston and cylinder assembly, wherein the piston is secured to the housing in a fixed position and the cylinder is slidably mounted on the piston, a cocking mechanism in mechanical communication with the piston and cylinder assembly including a shaft extending through the rotatable projectile device for engagement with the cylinder capable of moving the cylinder to a cocked position, and a projectile rotating mechanism secured to the shaft at the projectile device includes first and second coaxial barrels disposed adjacent each other about the shaft for facilitating the advancement of the rotatable projectile device and alignment of a projectile compartment to a firing position. A trigger mechanism is secured to the housing in mechanical communication with the projectile rotating mechanism capable of rotating the projectile device and releasing the cylinder from a cocked position to advance the cylinder on the fixed piston and discharge a burst of compressed air launching the projectiles in a rapid fire mode.

In yet another embodiment of the invention, the cylinder includes a cocking shoulder and the shaft includes a charging contact element disposed at an end opposite the projectile device for engagement with the cocking shoulder, and the shaft further includes a cocking handle disposed at an end opposite the charging contact element for manually charging the piston and cylinder assembly. In another embodiment, the projectile device includes a barrel rotatably disposed on the shaft having multiple projectile compartments and the barrel further facilitates the delivery of discharged compressed air from the piston and cylinder assembly to each projectile compartment.

In still yet another embodiment of the invention, the first barrel of the projectile rotating mechanism includes notches with an angled end disposed around the outer periphery defining a first set of slots with an angled end and the second barrel of the projectile rotating mechanism includes notches with an end angled in a reverse direction of the first notches disposed around the outer periphery and offset from the first notches to define a second set of slots with an end angled in a reverse direction and positioned offset from the first set of slots. In another embodiment, the trigger mechanism includes a trigger element and an advance lever capable of mechanically communicating with the first and second sets of slots to align projectile compartments to a firing position when the trigger is actuated capable of launching projectiles in a rapid fire mode.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
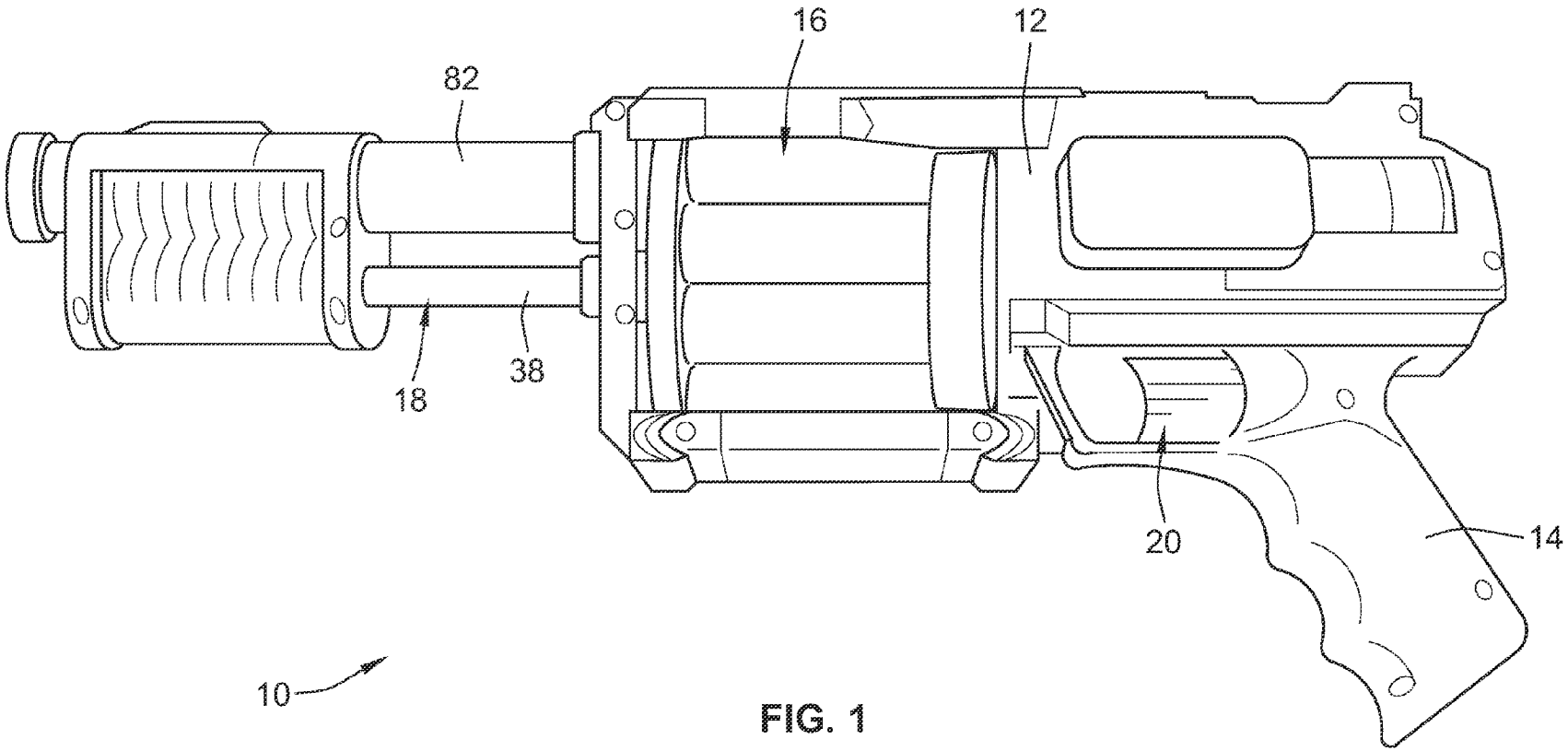
FIG. 1 is a perspective view of a toy projectile launcher of the present invention, illustrating a cocking mechanism extending through a projectile device.

A toy projectile launcher 10, as seen in FIG. 1, is generally seen to simulate the shape of a toy machine gun capable of rapid fire projectile launching through quick, simple and fun cocking and triggering mechanisms which are easy to actuate. In the present described embodiment, a housing assembly 12, is generally shaped like a gun and includes a handle 14. A projectile device 16 is disposed about the housing and a cocking mechanism 18 extends through the projectile device, as seen in FIG. 1. It is contemplated that the housing assembly 12 can incorporate alternate gun and projectile launcher shapes, such as a rocket launcher shape, etc., which are capable of incorporating a cocking mechanism extending through the projectile device.

Figure 2:
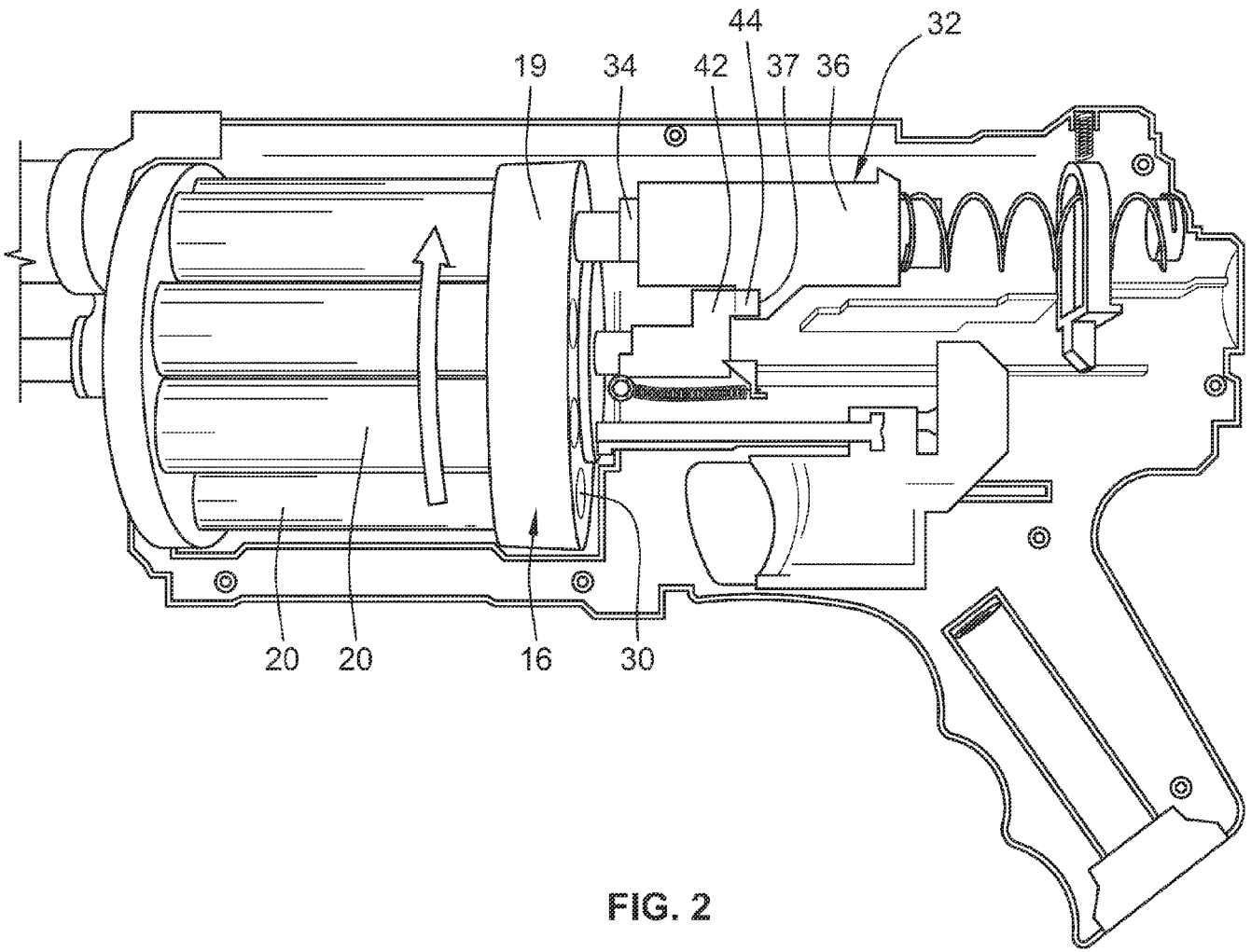
FIG. 2 is illustrating the projectile device in communication with a piston and cylinder assembly.
Figure 3B:
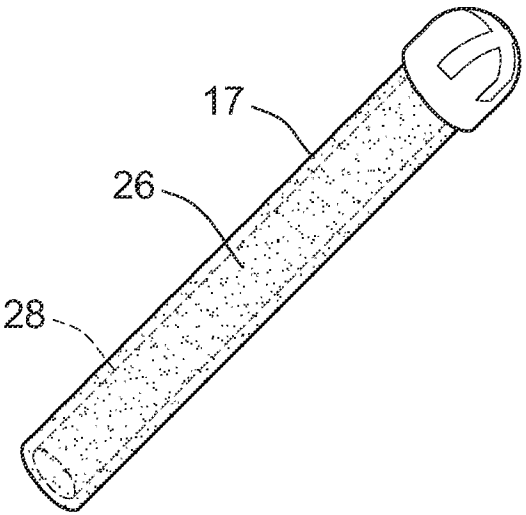
FIG. 3B is illustrating an embodiment of a projectile capable of loading into the projectile device.
Figure 3A:
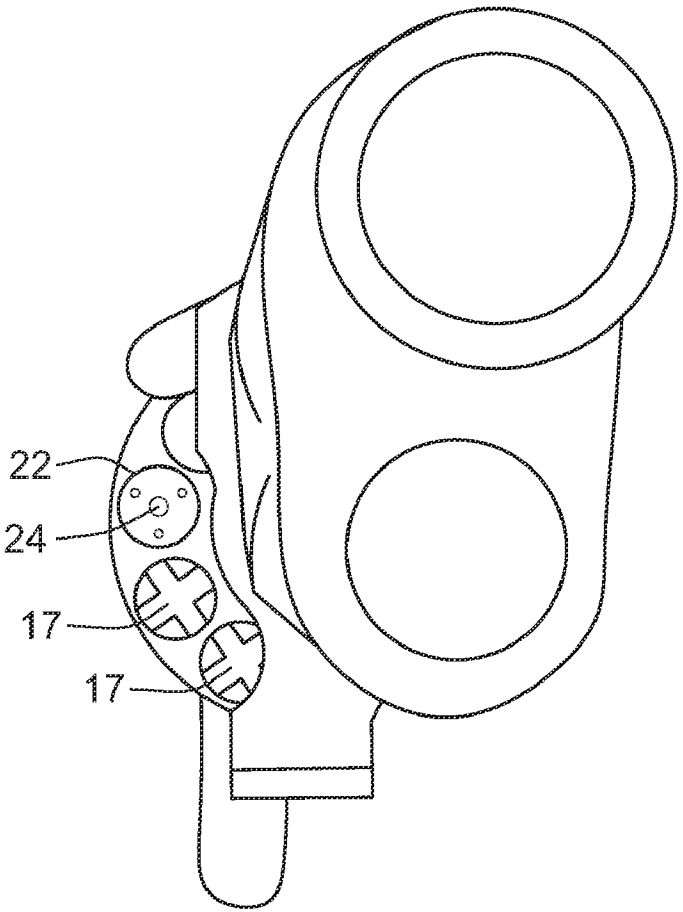
FIG. 3A is illustrating a projectile compartment within the projectile device.

The projectile device 16 includes two or more projectiles 17, and in the present described embodiment, as seen in FIGS. 1 & 2, the projectile device 16 includes a barrel 19 rotatably disposed on the cocking mechanism 18 having multiple projectile compartments 20. Each projectile compartment 20 is capable of housing a projectile 17 and rotating to a firing position for launching of the loaded projectile. In the present described embodiment, as seen in FIG. 3A, each projectile compartment is generally a hollow tube 22 which may include a central post 24 for loading the projectile 17 which has a substantially tubular body 26 with a hollow central portion 28, as seen in FIG. 3B. The barrel 19 further includes an air passage 30, as seen in FIG. 2, extending into each hollow tube 22. The air passage 30 facilitates the delivery of discharged compressed air from a piston and cylinder assembly 32 in the housing, to each hollow tube 22 to launch the projectiles 17.

The piston and cylinder assembly 32 is disposed about the housing 12 and generates a burst of compressed air, as mentioned above, to launch each projectile from the projectile device 16. The piston 34 is secured to the housing 12 in a fixed position and the cylinder 36 is slidably mounted on the piston. In the present described embodiment, the cylinder 36 has a hollow interior and a cocking shoulder 37, and slidably receives the stationary piston 34, as seen in FIG. 2. The piston 34 includes a fluid passage therethrough in fluid communication with the interior of the cylinder 36, such that the cylinder is movable relative to the housing 12 between an uncocked position and a cocked position, as seen in FIGS. 4A and 4B.

Figure 4A:
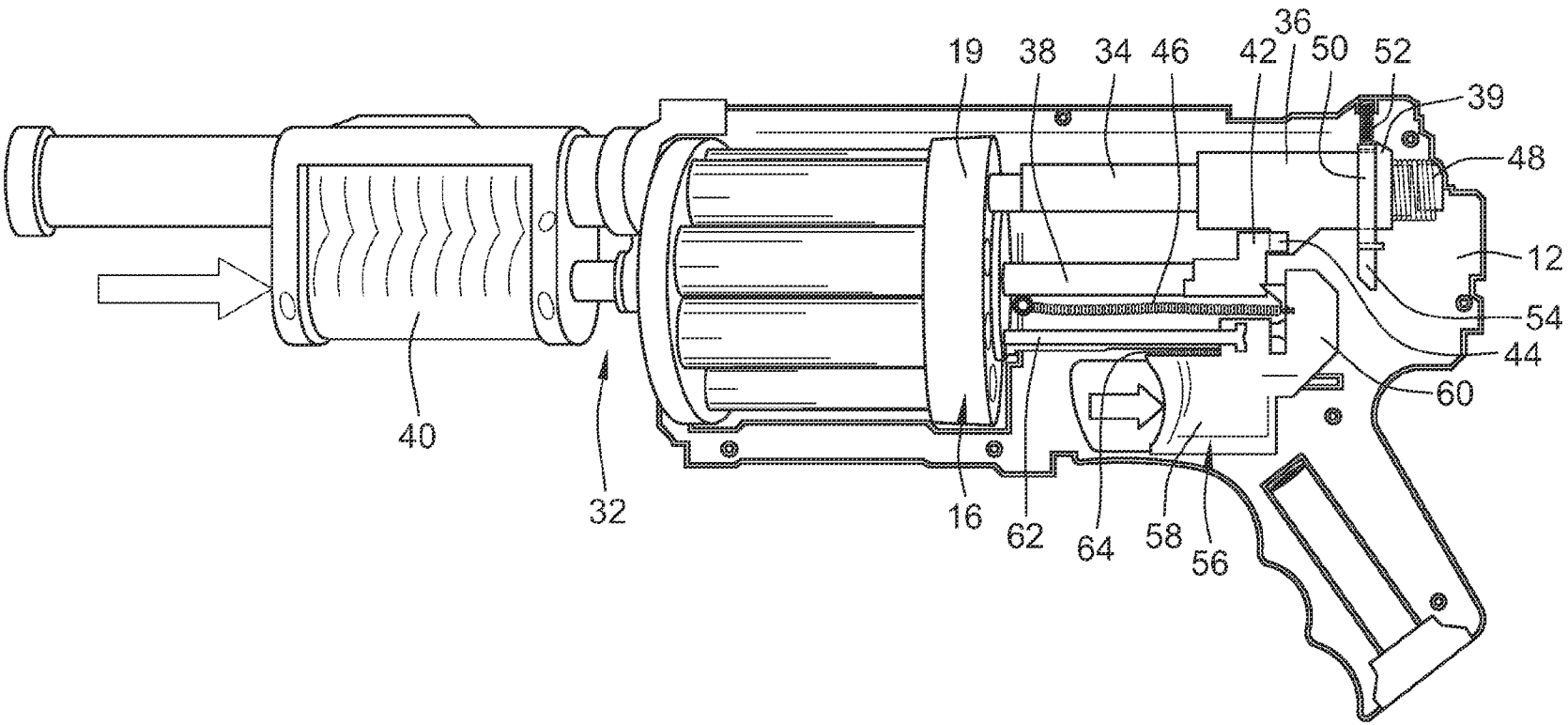
FIG. 4A is an embodiment of the toy projectile launcher illustrating the cocking mechanism moving the cylinder away from the piston to a cocked position, with FIG. 4B illustrating the cylinder in an uncocked position.
Figure 4B:
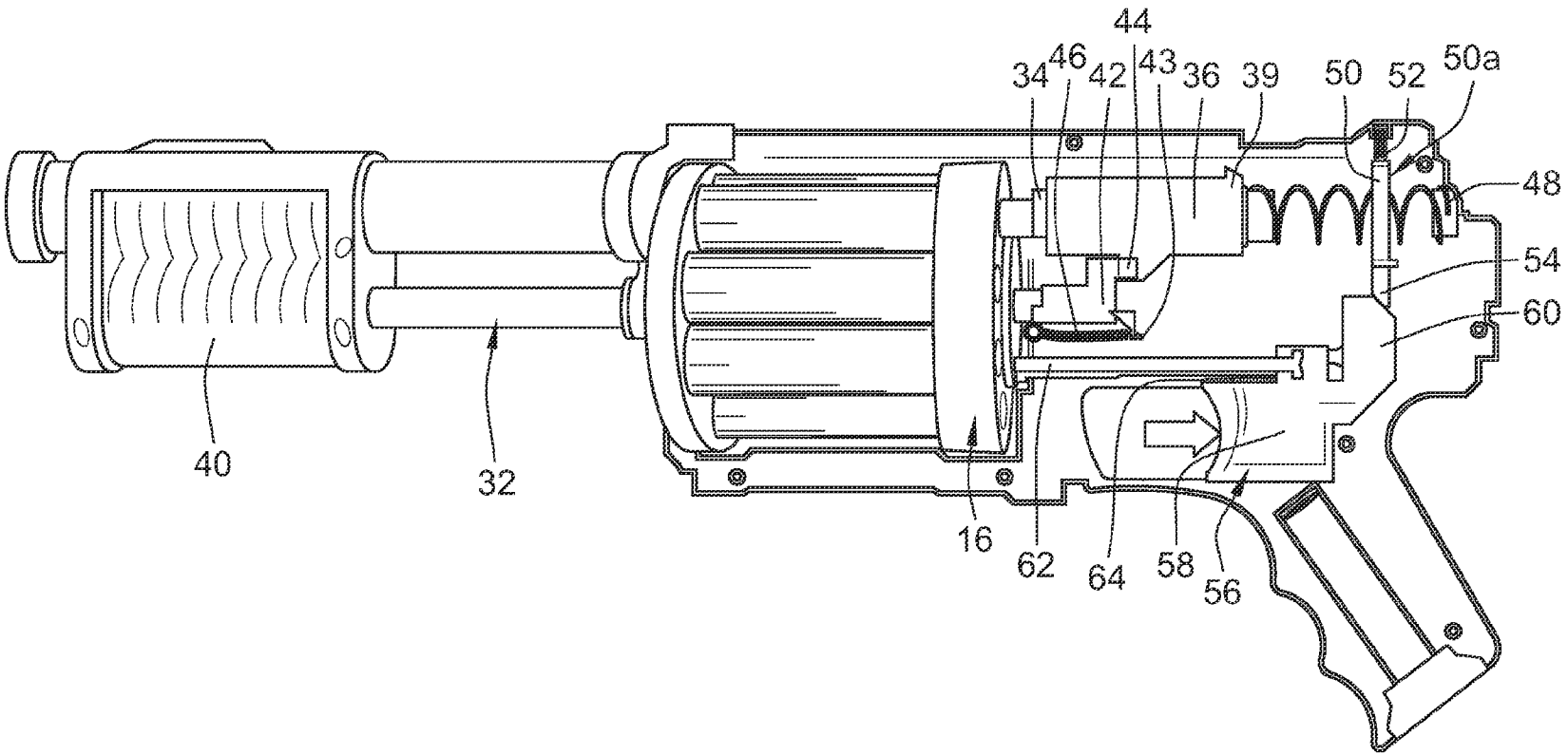

Movement of the cylinder 36 from the cocked position, as seen in FIG. 4A, to an uncocked position, as seen in FIG. 4B, compresses air in the hollow interior of the cylinder 36 with the compressed air being delivered through the fluid passage of the piston 34 to the projectile device 16 to launch the projectile 17. The structure of the stationary piston 34 and slidable cylinder 36 which generates a burst of compressed air for launching a projectile is disclosed by applicants assignee in U.S. Pat. No. 7,287,526 to Bligh et al, which is hereby incorporated by reference.

The cylinder 36 is biased toward the piston 34, as seen in FIG. 4B, urging the cylinder along a substantially linear path toward the piston and toward a firing or uncocked position. In the present described embodiment, a biasing spring 48, is disposed about the housing 12 and in mechanical communication with the cylinder 36, as seen in FIGS. 4A & 4B, and generates the mechanical energy needed to rapidly move the cylinder over the piston to generate the burst of compressed air needed to launch the projectile.

The cocking mechanism 18, is in mechanical communication with the piston and cylinder assembly 32, as seen in FIGS. 4A-4B, and includes a shaft 38 for engagement with the cylinder 36 capable of moving the cylinder to a cocked position. The shaft 38, as seen in FIG. 4A, extends through the projectile device 16, mounting the rotatable barrel 17 on the shaft 38, and includes a cocking handle 40 disposed at an end of the shaft 38 for manually forcing the shaft through the projectile device and into the housing 12 to move the cylinder to a cocked position.

The shaft 38 also includes a charging contact element 42 disposed at an end opposite the projectile device and cocking handle, for engagement with the cocking shoulder 37 of the cylinder. In the present described embodiment, the charging contact element 42 has a rigid structure which extends beyond the shaft along an axis perpendicular to the shaft, as seen in FIG. 4A. Further, a side wing 44, also having a rigid and unyielding structure, is affixed or integral with the contact element 42, defining a side wall, which somewhat envelopes a side of the cocking shoulder 37 when the shaft 38 is moving the cylinder to a cocked position.

As the shaft 38 is moved into the housing 12, as seen in FIG. 4A, the extending, rigid, and somewhat enveloping structure of the charging contact element 42 makes a secure mechanical connection with the protruding shoulder 37 of the cylinder, to prevent any slipping or disengagement of the shaft 38 from the cylinder 36 as the shaft forces the cylinder into a cocked position. This secure, efficient, and reliable connection allows the cocking mechanism to quickly and repeatedly cock the piston and cylinder assembly between each projectile launch for rapid fire launching of the projectiles.

Additionally, the shaft 38 is biased away from contact with the cylinder toward an uncocked position, such that the shaft 38 and attached charging contact element 42 are automatically and rapidly moved away from the cylinder 36 and the cocking shoulder 37 once the cylinder has been secured and locked into the cocked position. This fast movement removing the shaft from contact with the cylinder after cocking is accomplished, prevents the cocking mechanism from interfering with the rapid movement of the cylinder across the piston when launching of the projectiles is desired.

Biasing the shaft away from contact with the cylinder also readies the cocking mechanism for further quick and repeated cocking of the cylinder. In the present described embodiment, a biasing spring 46 is secured to the housing at one end and to the charging contact element 42 of the shaft at an opposite end. The charging contact element 42 includes a hook 43 affixed or integral with the element 42 for securing an end of the biasing spring 46 to the element 42.

A locking ring 50 is disposed on the housing 12 for locking the cylinder 36 into a cocked position until a user is ready to launch the projectile. In the present described embodiment, the cylinder 36 includes a lip 39 affixed or integral with the cylinder to catch on a surface 50*a* of the locking ring 50, locking the cylinder into a cocked position against the urging force of the biasing spring 48. The locking ring 50 is spring biased 52 toward contact with the lip 37 of the cylinder, and further includes a protrusion 54 which extends into the path of a trigger mechanism 56 capable of releasing the cylinder from locked position.

The trigger mechanism 56 is secured to the housing 12 and includes a trigger element 58, a launching contact shoulder 60 and an advance lever 62 capable of accomplishing the dual purpose of advancing the projectile device to a firing position and releasing the cylinder from a cocked position to advance the cylinder on the fixed piston and discharge a burst of compressed air launching a projectile. A full trigger pull of the trigger element 58 will move the launching contact shoulder 60 into contact with the protrusion 54 of the locking ring 50, as seen in FIG. 4B forcing the locking ring against the urging of the biasing spring 52 and releasing the lip 37 of the cylinder 36 from contact with the ring surface 50*a*, allowing the cylinder to advance along the piston launching a loaded projectile.

The trigger mechanism 56 is biased away form contact with the protrusion 54 of the locking ring 50. In the present described embodiment, a biasing spring 64, as seen in FIGS. 4A & 4B, is secured to the housing 12 at one end and to the trigger mechanism 56 at an opposite end for urging the launching contact shoulder 60 away from contact with the protrusion 54 of locking ring 50. This prevents the trigger mechanism 56 from interfering with the locking of the cylinder 36 into a cocked position and readies the trigger element 58 for rapid and repeated actuation of the cocked piston and cylinder assembly 32.

A full trigger pull of the trigger element 58 will launch a loaded projectile from the projectile device 16, as described above, and a half trigger pull of the trigger element 58 will rotate the projectile device to align the projectile device 16 to the firing position. The unique positioning of the cocking mechanism 32 extending through the projectile device 16 facilitates the mechanical communication between the trigger mechanism 56 and the projectile device 16 capable of advancing the device to a firing position with the same trigger pull used to release the cocked cylinder and launch the projectile. The projectile device is thus disposed on the housing assembly, with the cylinder on the fixed piston slidably mounted on the fixed piston and moveable between a cocked position and an uncocked position. The cocking mechanism accordingly extends through the projectile device in mechanical communication with the cylinder for moving the cylinder to the cocked position on the fixed piston. As described, the central cocking mechanism and the trigger mechanism with the advance lever extending into the projectile device operate together for advancing the projectile device to a firing position and releasing the cylinder from the cocked position to move the cylinder on the fixed piston and discharge a burst of compressed air launching a projectile.

In the present described embodiment, the advance lever 62 of the trigger mechanism 56 is in mechanical communication with the projectile device 16, facilitating the rotation of the projectile device 16 and rotatably aligning each projectile compartment 20 to the firing position. The rotatable barrel 19 of the projectile device 16 includes a projectile rotating mechanism 66 mounted about the shaft 38 and in mechanical communication with the advance lever 62.

Figure 5:
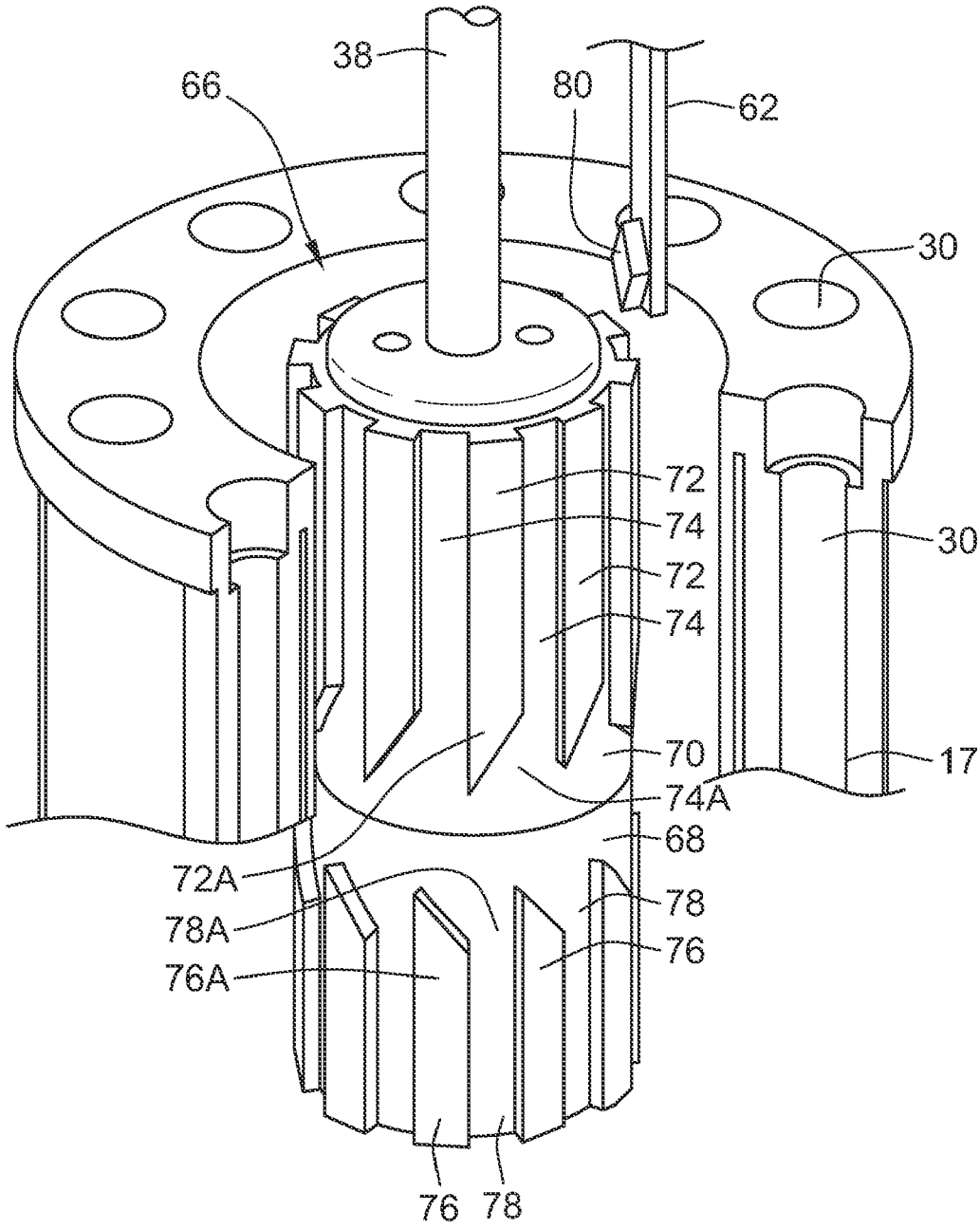
FIG. 5 is a perspective view of an embodiment of a projectile rotating mechanism illustrating first and second coaxial barrels disposed about the projectile device about the shaft.

In the present described embodiment, the projectile rotating mechanism 66 includes first and second coaxial barrels, 68 and 70, respectfully, disposed adjacent each other about the shaft 38, as seen in FIG. 5. The first barrel 68 includes notches 72, each with an angled end 72*a*, disposed around an outer periphery of barrel 68 defining a first set of slots 74, each with an angled end 74*a*. The second barrel 70 includes notches 76, each with an end 76*a*, angled in a reverse direction of the first notches 72 disposed around an outer periphery of barrel 70 and offset from the first notches 72 to define a second set of slots 78, each with an end 78*a* angled in the reverse direction and positioned offset from the first set of slots 74. The advance lever 62 is capable of mechanically communicating with the first and second sets of slots, 74 & 78 respectively, to align the projectile compartments 20 to a firing position when the trigger element 58 is actuated to a half click trigger pull.

Figure 6A:
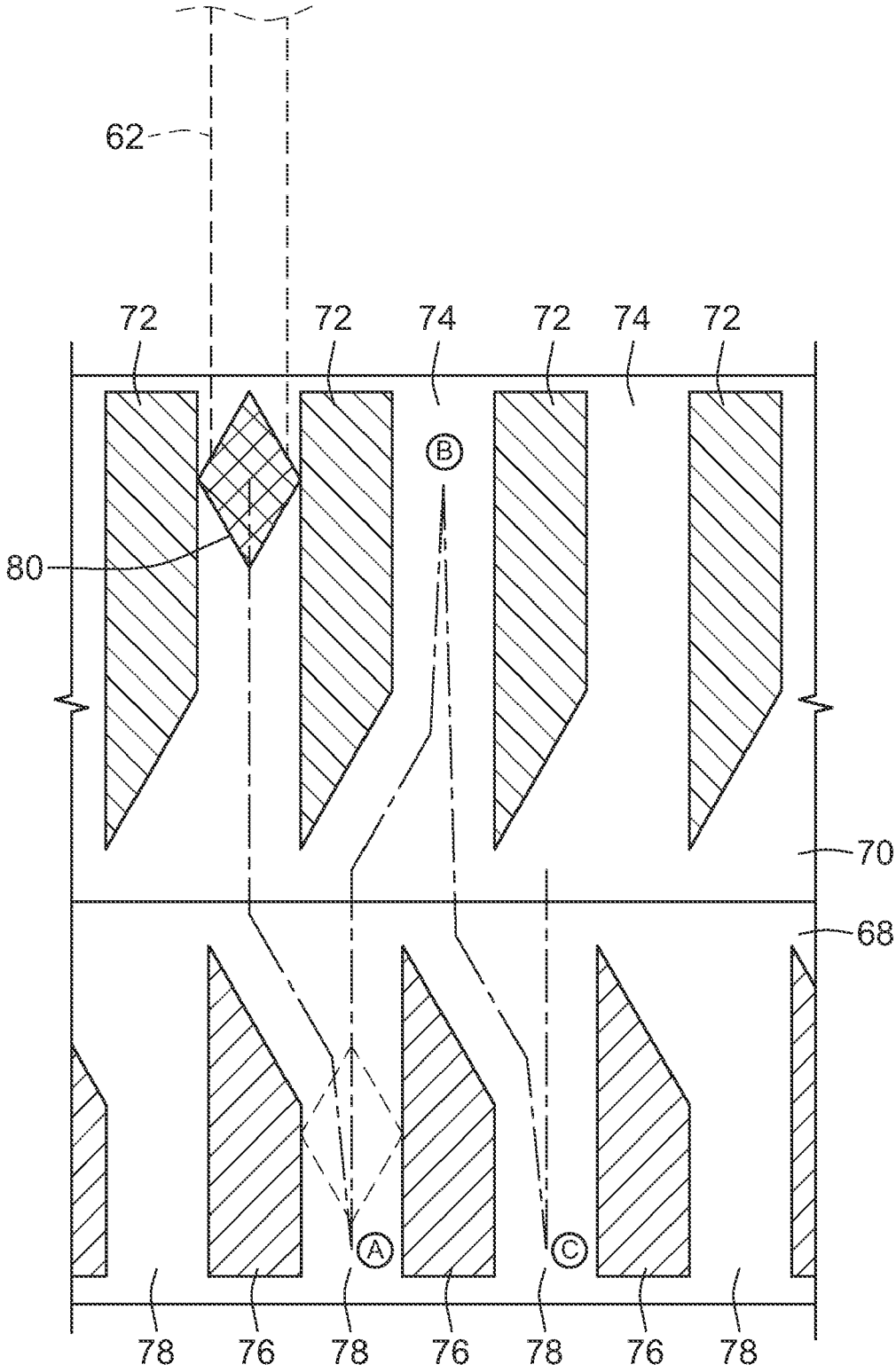
FIG. 6A is a diagrammatic view of the first and second coaxial barrels illustrating a path taken by an advance lever to rotate the projectile device when the trigger mechanism is actuated.

The advance lever 62 includes an elongated protrusion 80 at an end opposite the trigger element 58 capable of traveling along first and second slots, 74 & 78 respectively. In a present described embodiment, as seen in FIGS. 5 & 6A, the elongated protrusion 80 is diamond shaped. The advance lever extends into the projectile device for mechanically communicating with the first and second sets of slots to align the projectile compartments to a firing position when the trigger element is actuated for launching projectiles sequentially in the rapid fire mode. It is also contemplated that the protrusion 80 can include alternative shapes, for example rectangular or triangular, etc., such that the protrusion is capable of traveling along first and second slots 74 & 78, respectively, to rotate the projectile device 16.

In use, as diagramed in FIG. 6A, the advance lever resides with the protrusion 80 positioned within the second set of slots 78 at point A. An initial half click trigger pull will cause the elongated protrusion 80 to travel from a second slot 78 to an offset first slot 74 rotating a projectile compartment 20 one half increment, to a firing position. A further full click trigger pull will launch the loaded projectile and the elongated protrusion 80 will travel to an end of slot 74 opposite the angle 74*a* to point B. A further trigger release will cause the elongated protrusion 80 to travel to a next sequential second slot 78, to point C, rotating a next sequential projectile compartment 20 one half increment, and out of firing position.

This stepwise advancement of the barrel 19 continues with each pull of the trigger element 58. Each time the barrel 19 is moved one increment, a projectile compartment and loaded projectile is moved to the firing position facilitating the quick simple and fun rapid fire of two or more projectiles.

Figure 6B:
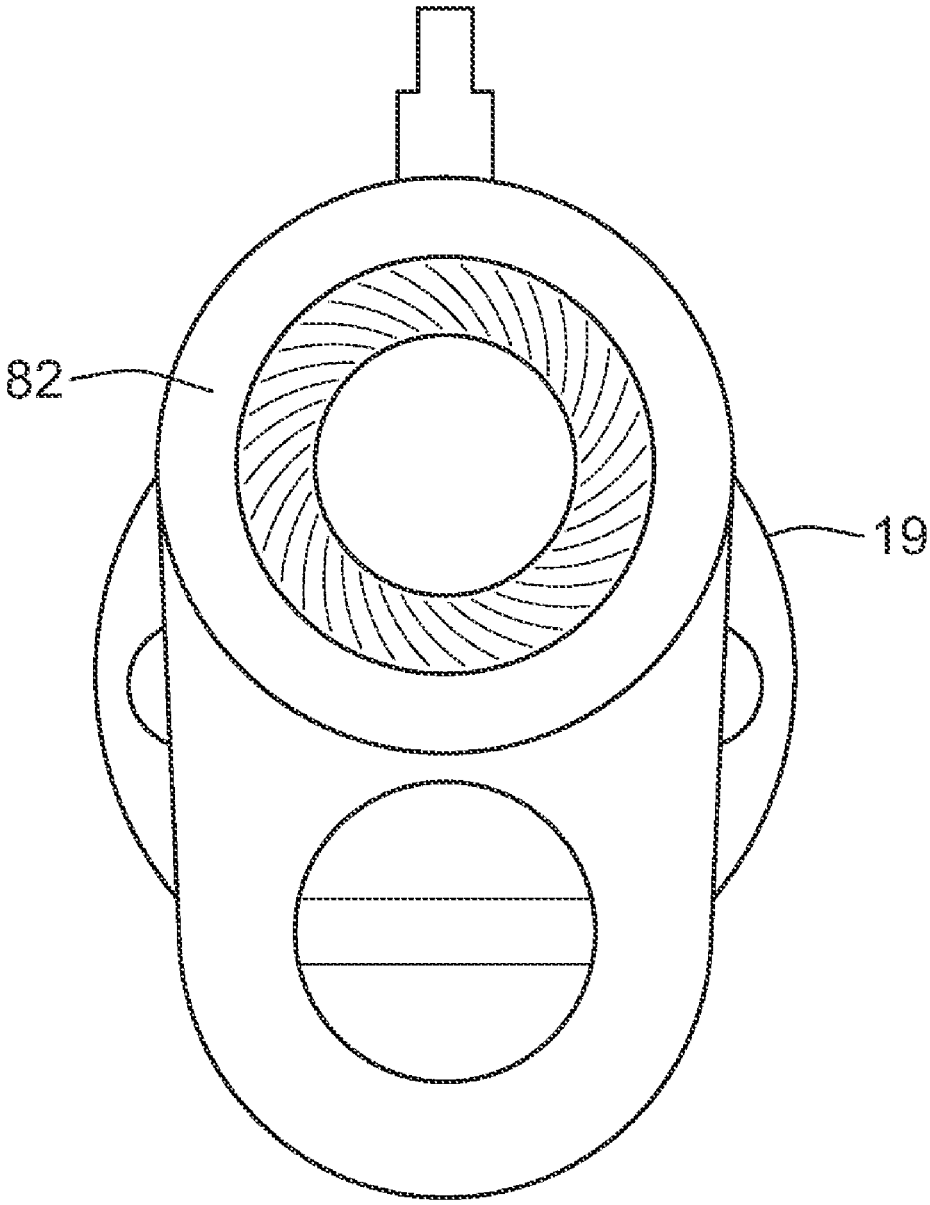
FIG. 6B illustrates an elongated barrel aligned generally parallel with the cocking mechanism and capable of aligning with the projectile device in a firing position.

Additionally, in the present described embodiment, an elongated barrel 82, as seen in FIGS. 1 & 6B extends from the housing 12 and is aligned generally parallel to the shaft 38. The elongated barrel 82 aligns with each projectile compartment 20 when in the firing position, wherein each projectile 17 passes through the barrel when launched. The elongated barrel 82 helps facilitate the ejection of the launched projectiles out away from the toy 10, and helps assist a user in more accurately launching the projectiles toward a desired target.

A method for launching two or more projectiles from a toy includes the steps of providing a housing assembly, disposing a projectile device with two or more projectiles about the housing assembly, providing a piston and cylinder assembly, securing the piston in a fixed position to the housing and mounting the cylinder to slide back and forth over the piston, and providing a cocking mechanism in mechanical communication with the piston and cylinder assembly by passing a shaft through the projectile device for engagement with the cylinder and facilitating the launch of two or more projectiles. The method further includes manually pushing the shaft into the housing assembly and into contact with the cylinder assembly forcing the cylinder to a cocked position, and activating a trigger mechanism capable of advancing the projectile device to a firing position and releasing the cylinder from a cocked position, advancing the cylinder over the fixed piston discharging a burst of compressed air and launching the projectiles from the projectile device.

The cylinder further provides a cocking shoulder extending therefrom and the cocking mechanism further provides a charging contact element disposed on the shaft for engagement with the shoulder for moving the cylinder into a cocked position. The cocking mechanism also provides a cocking handle disposed on the shaft at an end opposite the charging contact element, and the method further provides the step of biasing the shaft toward an uncocked position by biasing the contact element away from the cylinder is included.

The projectile device further provides a rotatable barrel having multiple projectile compartments each capable of rotatably aligning with the piston and cylinder assembly in a firing position, and facilitating the delivery of compressed air discharged from the assembly to each projectile in each projectile compartment. The method further provides the step of advancing the rotatable barrel to rotatably align each projectile compartment to the firing position when the trigger mechanism is actuated is included.

From the foregoing, it can be seen that there has been provided a unique toy for launching two or more projectiles in a rapid fire mode through quick, simple and fun cocking and triggering mechanisms which are easy to actuate. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A toy for launching two or more projectiles; comprising:

a housing assembly;

a projectile device disposed on the housing assembly, the projectile device capable of receiving two or more projectiles;

a fixed piston secured to the housing assembly at a fixed position;

a cylinder on the fixed piston, wherein the cylinder is slidably mounted on the fixed piston and moveable between a cocked position and an uncocked position;

a cocking mechanism extending through the projectile device in mechanical communication with the cylinder for moving the cylinder to the cocked position on the fixed piston;

a trigger mechanism secured at the housing assembly; and an advance lever extending into the projectile device operable with the trigger mechanism for advancing the projectile device to a firing position and releasing the cylinder from the cocked position to move the cylinder on the fixed piston and discharge a burst of compressed air launching a projectile.

2. The toy according to claim 1, wherein the cylinder further includes a cocking shoulder and wherein the cocking mechanism further includes a charging contact element disposed at an end opposite the projectile device for engagement with the cocking shoulder.

3. The toy according to claim 2, wherein the cocking mechanism further includes a cocking handle disposed at an end opposite the charging contact element and wherein the cocking mechanism is biased away from contact with the cylinder toward the uncocked position.

4. The toy according to claim 1, wherein the projectile device includes a barrel rotatably disposed on the cocking mechanism having multiple projectile compartments and wherein the barrel further facilitates the delivery of discharged compressed air from the fixed piston and cylinder to each projectile compartment.

5. The toy according to claim 4, wherein the rotatable barrel further includes first and second coaxial barrels disposed adjacent each other about the cocking mechanism facilitating the advancement of the barrel and alignment of a projectile compartment to the firing position when the trigger mechanism is actuated.

6. The toy according to claim 5, wherein the first barrel includes notches with an angled end disposed around an outer periphery defining a first set of slots with an angled end and wherein the second barrel includes notches with an end angled in a reverse direction of the first notches disposed around an outer periphery and offset from the first notches to define a second set of slots with a reverse angled end positioned offset from the first set of slots.

7. The toy according to claim 6, wherein the trigger mechanism includes a trigger element operable with the advance lever extending into the projectile device for mechanically communicating with the first and second sets of slots to align the projectile compartments to a firing position when the trigger element is actuated for launching projectiles sequentially.

8. The toy according to claim 7, wherein the advance lever includes an elongated protrusion at an end opposite the trigger element for traveling from a second slot to an offset first slot rotating a projectile compartment to a firing position with a half click trigger pull, launching the projectile with a further full click trigger pull, and traveling to a next sequential second slot rotating a next sequential projectile compartment out of firing position with a trigger release.

9. The toy according to claim 4, further comprising an elongated barrel extending from the housing aligned generally parallel to the shaft and aligning with each projectile compartment when in the firing position, wherein each projectile passes through the barrel when launched.

10. A method for launching two or more projectiles from a toy; comprising the steps of:

providing a housing assembly;

disposing a projectile device with two or more projectiles about the housing assembly;

providing a piston and cylinder assembly, securing the piston in a fixed position to the housing and mounting the cylinder to slide back and forth over the piston;

providing a cocking mechanism in mechanical communication with the piston and cylinder assembly by passing a shaft through the projectile device for engagement with the cylinder and facilitating the launch of two or more projectiles;

extending the cocking mechanism through the projectile device for pushing the shaft into the housing assembly and into contact with the cylinder assembly forcing the cylinder to a cocked position;

activating a trigger mechanism for advancing the projectile device to a firing position and releasing the cylinder from a cocked position, advancing the cylinder over the fixed piston discharging a burst of compressed air and launching the projectiles from the projectile device.

11. The method according to claim 10, wherein the cylinder further provides a cocking shoulder extending therefrom and the cocking mechanism further provides a charging contact element disposed on the shaft for engagement with the shoulder for moving the cylinder into a cocked position.

12. The method according to claim 11, wherein the cocking mechanism further provides a cocking handle disposed on the shaft at an end opposite the charging contact element.

13. The method according to claim 12, further comprising the step of biasing the shaft toward an uncocked position by biasing the contact element away from the cylinder.

14. The method according to claim 11, wherein the projectile device further provides a rotatable barrel having multiple projectile compartments each rotatably aligning with the piston and cylinder assembly in a firing position, and facilitating the delivery of compressed air discharged from the assembly to each projectile in each projectile compartment.

15. The method according to claim 14, further comprising the step of advancing the rotatable barrel to rotatably align each projectile compartment to the firing position when the trigger mechanism is actuated.

16. A toy for launching two or more projectiles, comprising:

a housing assembly;

a rotatable projectile device disposed about the housing and including two or more projectile chambers each including at least one projectile;

a piston and cylinder assembly, wherein the piston is secured to the housing in a fixed position and the cylinder is slidably mounted on the piston;

a cocking mechanism in mechanical communication with the piston and cylinder assembly including a shaft extending through the rotatable projectile device for engagement with the cylinder for moving the cylinder to a cocked position;

a projectile rotating mechanism mounted about the shaft at the projectile device includes first and second coaxial barrels disposed adjacent each other about the shaft for facilitating the advancement of the rotatable projectile device and alignment of a projectile compartment to a firing position;

a trigger mechanism secured to the housing in mechanical communication with the projectile rotating mechanism for rotating the projectile device and releasing the cylinder from a cocked position to advance the cylinder on the fixed piston and discharge a burst of compressed air launching the projectiles in a rapid fire mode.

17. The toy according to claim 16, wherein the cylinder includes a cocking shoulder and wherein the shaft includes a charging contact element disposed at an end opposite the projectile device for engagement with the cocking shoulder, and the shaft further includes a cocking handle disposed at an end opposite the charging contact element for manually charging the piston and cylinder assembly.

18. The toy according to claim 17, wherein the projectile device includes a barrel rotatably disposed on the shaft having multiple projectile compartments and wherein the barrel further facilitates the delivery of discharged compressed air from the piston and cylinder assembly to each projectile compartment.

19. The toy according to claim 18, wherein the first barrel of the projectile rotating mechanism includes notches with an angled end disposed around the outer periphery defining a first set of slots with an angled end and wherein the second barrel of the projectile rotating mechanism includes notches with an end angled in a reverse direction of the first notches disposed around the outer periphery and offset from the first notches to define a second set of slots with an end angled in a reverse direction and positioned offset from the first set of slots.

20. The toy according to claim 19, wherein the trigger mechanism includes a trigger element and an advance lever mechanically communicating with the first and second sets of slots to align projectile compartments to a firing position when the trigger element is actuated for launching projectiles in a rapid fire mode.

* * * * *